United States Patent [19]

Schwalm

[11] 4,093,195

[45] June 6, 1978

[54] CARBURIZING FURNACE

[75] Inventor: Donald J. Schwalm, Northville, Mich.

[73] Assignee: Holcroft & Company, Livonia, Mich.

[21] Appl. No.: 760,567

[22] Filed: Jan. 19, 1977

[51] Int. Cl.[2] ..... C21D 1/00

[52] U.S. Cl. ..... 266/251; 266/261

[58] Field of Search ..... 266/44, 130, 251, 252, 266/261; 432/23, 26, 130, 133, 144, 145, 149, 150, 152, 199

[56] References Cited

U.S. PATENT DOCUMENTS

| | | | |
|---|---|---|---|
| 3,356,541 | 12/1967 | Cullen | 266/252 X |
| 3,662,996 | 5/1972 | Schwalm | 266/130 X |

*Primary Examiner*—Roy Lake
*Assistant Examiner*—Paul A. Bell
*Attorney, Agent, or Firm*—Whittemore, Hulbert & Belknap

[57] ABSTRACT

Apparatus and method for carburizing and carbonitriding ferrous metal work in a continuous furnace having aligned heating, carburizing and diffusing zones. Each zone is provided with fan means in at least one side wall of the furnace, with both the inlet and the outlet of the fan at a level below the work trays which are conveyed through the furnace so that the gas atmosphere is pulled downwardly through the work at one or more pier positions within a processing zone and pushed upwardly through the work at the remaining pier positions within the zone. By proper refractory design and fan locations a more uniform and controllable flow pattern is provided throughout the length and width of each processing zone.

16 Claims, 11 Drawing Figures

CARBURIZING FURNACE

BACKGROUND OF THE INVENTION

Fans are used in carburizing and carbonitriding furnaces to circulate a controlled gas atmosphere through the work in an effort to obtain uniform heating of the work and to enhance the transfer of carbon and nitrogen from the atmosphere to the surface of the work. Their effectiveness depends on the flow rate and the degree of uniformity of flow that can be achieved at the surface of the work. Prior art furnaces have utilized fans mounted in the top of the furnace, in the side walls, or in the furnace floor. Such prior designs are subject to the disadvantage of utilizing a controllable flow through the work from only one side of the fan, either the suction or the pressure side. In addition, prior designs have not been able to achieve substantially uniform and controlled flow throughout the length and width of a processing zone.

According to the present disclosure, a continuous carburizing furnace has aligned heating, carburizing and diffusion zones, and longitudinally spaced piers on the floor of the furnace in each of the zones. Work supporting trays are conveyed along suitable conveyer means supported on the piers. Each zone is provided with a fan for circulating the controlled gas atmosphere within that zone through the work. The fan is mounted in the lower portion of a side wall of the furnace in such position that both its inlet and its outlet are at a level below the level of the work trays, with the inlet and outlet longitudinally spaced apart and separated by at least one of the piers in such zone so that the gas atmosphere is pulled downwardly through the work at one or more pier positions and is forced upwardly through the work in the remaining pier positions of the processing zone. The refractory material is designed in relation to the fan inlet and outlet in such a way as to provide a controllable and substantially uniform flow on both the suction and pressure sides of the fan throughout the length and width of the processing zone.

IN THE DRAWINGS

DESCRIPTION OF A PREFERRED EMBODIMENT

Figure 1:
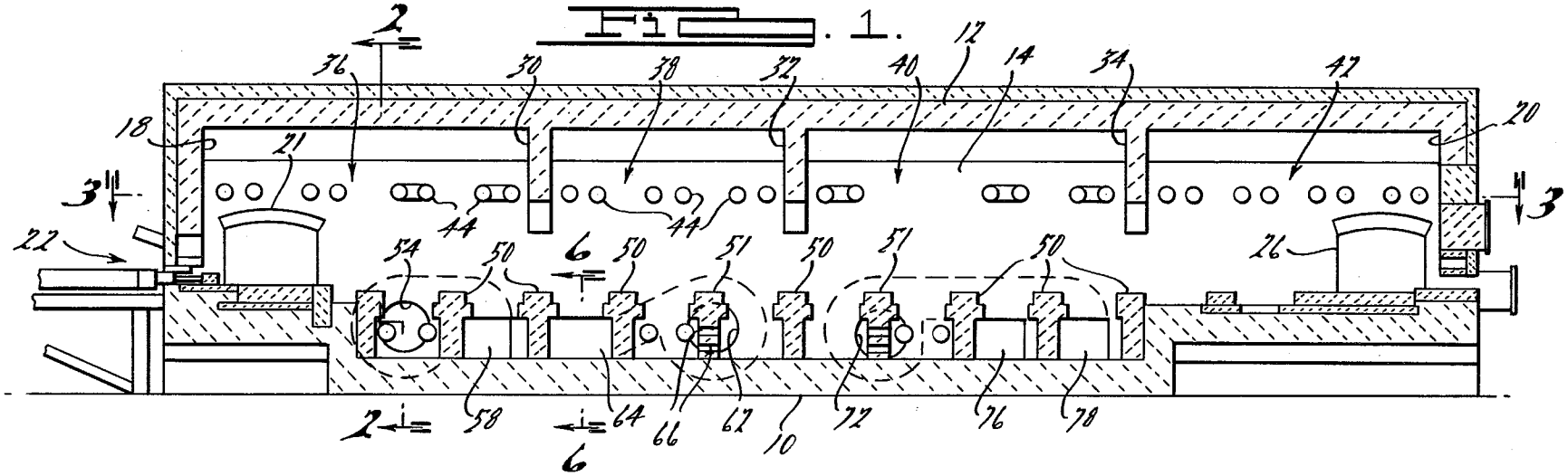
FIG. 1 is a vertical sectional view through a carburizing furnace according to the present invention.
Figure 2:
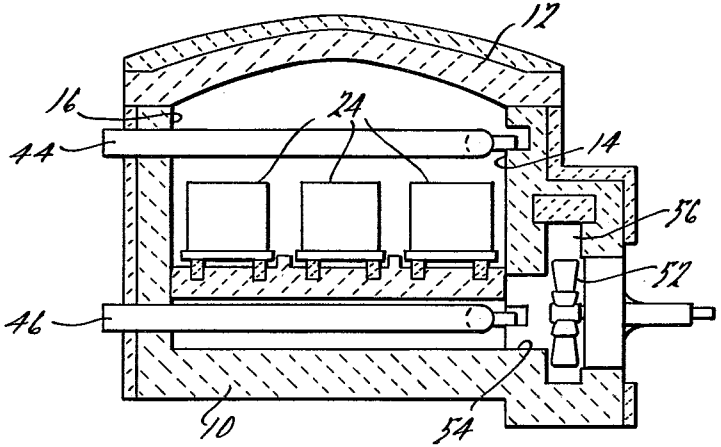
FIG. 2 is a transverse sectional view taken on line 2—2 of FIG. 1.
Figure 3:
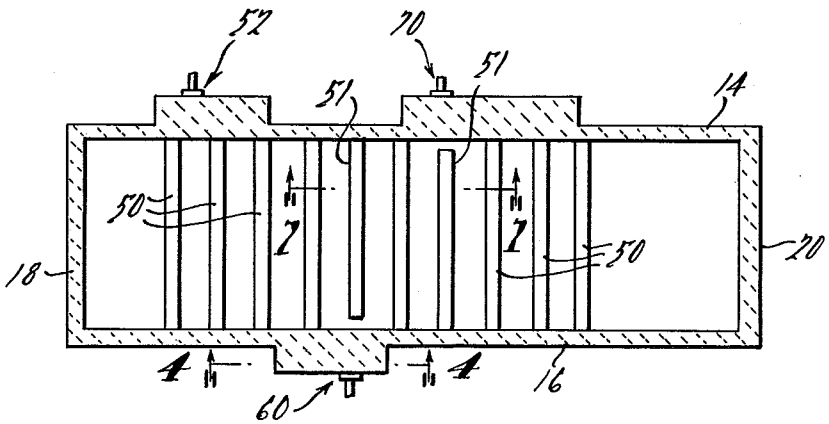
FIG. 3 is a horizontal sectional view taken along line 3—3 of FIG. 1.
Figure 4:
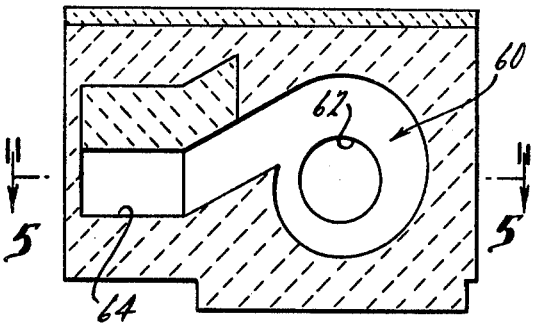
FIG. 4 is a vertical sectional view taken on line 4—4 of FIG. 3.

The continuous carburizing or carbonitriding furnace illustrated in FIGS. 1 to 8 comprises a floor 10, a top wall 12, side walls 14 and 16, and end walls 18 and 20. The inlet end of the furnace includes an access door indicated at 20 and a pusher mechanism generally at 22 for pushing the work trays 24 longitudinally through the furnace along suitable track means. A door indicated at 26 is provided at the opposite end of the furnace for discharging the trays of processed work from the furnace. Suitable conveyer means and pusher means are provided for charging the work trays into and discharging the trays from the furnace. These structures may be of conventional design and are not illustrated herein.

Arches 30, 32 and 34 supported from the side walls 14 and 16 of the furnace separate the interior of the furnace into a heating zone 36, a carburizing zone 38, a diffusing zone 40, and a discharge zone 42 at the discharge end of the furnace. Within each of the several zones of the furnace a series of radiant heating tubes 44 extend transversely between the side walls 14 and 16 for heating the furnace to the required processing temperature. Similar heating tubes 46 extend across the furnace just above the floor 10.

A series of piers 50 made of refractory material are mounted on the floor 10 and extend transversely between the side walls 14 and 16. Suitable tracks or the like may be mounted on the upper surfaces of the piers 50 to support the work trays which are conveyed through the furnace.

Each of the zones 36, 38 and 40 is provided with a fan means for circulating the controlled gas atmosphere within such zone through the work that is passing through the zone. A fan 52 in the heating zone 36 is mounted in the side wall 14 adjacent the floor 10 and has a central inlet 54 opening into the furnace chamber below the level of the upper ends of the piers 50 on which the work trays are supported. The refractory is suitably tunneled to provide a passage 56 through which the peripheral discharge of the fan is directed to an outlet 58 which is also disposed below the level of the top of the piers 50. The inlet 54 and the outlet 58 of the fan 52 are separated by at least one of the piers 50, as shown in FIG. 1, so that the controlled gas atmosphere will be pulled downwardly through the work in the work tray at the first pier position within heating zone 36 while the atmosphere will be forced upwardly from the outlet 58 through the work in the work tray at the next advanced pier position within the zone 36.

Figure 5:
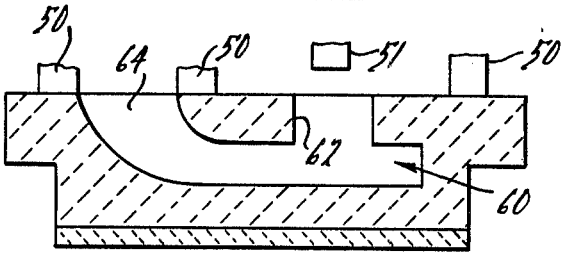
FIG. 5 is a horizontal sectional view taken on line 5—5 of FIG. 4.

Within the carburizing zone 38 a similar fan 60 is mounted in the side wall 16 and has it inlet 62 and its outlet 64 both disposed below the level of the top of the piers 50. The gas atmosphere will therefore be forced upwardly through the work at the first pier position within the carburizing zone 38 and will be pulled downwardly through the work at the next two adjacent pier positions. One of the piers 50 separates the inlet 62 from the outlet 64 of the fan 60 and, as shown in FIG. 1, the pier 51 which is opposite the fan inlet 62 may be checkered or provided with openings 66 so that the downward flow of atmosphere into the fan inlet is uniform and controlled on both sides of the pier 51. In addition, as shown in FIG. 5, the pier 51 terminates short of the side wall 16 in which the fan is mounted to allow free flow into the fan inlet 62.

The diffusing zone 40 is provided with a fan 70 which also has its inlet 72 disposed below the level of the tops of the piers 50 and the pier 51 which is opposite the inlet of fan 70 is also constructed in the same manner as the pier 51 previously described. The fan 70 is mounted in the side wall 14 which is tunneled to provide a passage 74 which communicates with two outlets 76 and 78, the outlets 76 and 78 also being disposed below the level of the top of the piers 50. The outlets 76 and 78 are separated by a pier 50 and the fan inlet 72 is separated from the outlets 76 and 78 by a pier 50. By means of this construction the atmosphere will be pulled downwardly through the work at the pier positions to the left of the piers 50 in zone 40 and will be forced upwardly through the work at the other pier positions.

Figure 6:
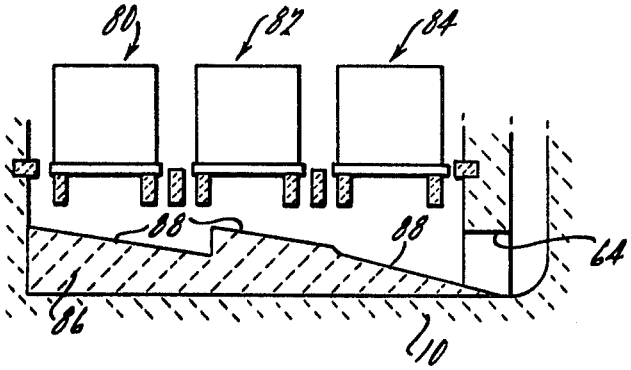
FIG. 6 is a vertical sectional view taken on line 6—6 of FIG. 1.
Figure 7:
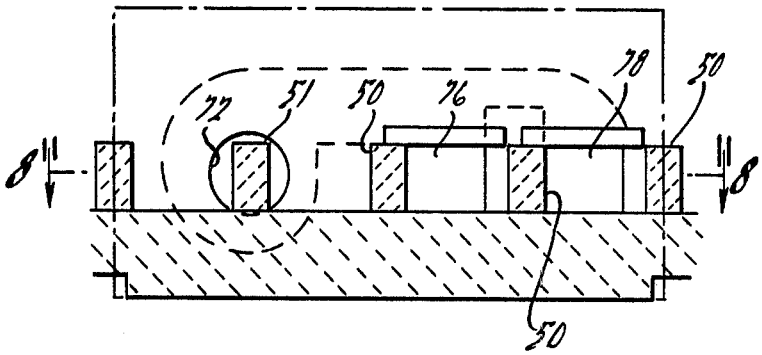
FIG. 7 is a vertical sectional view taken on line 7—7 of FIG. 3.
Figure 8:
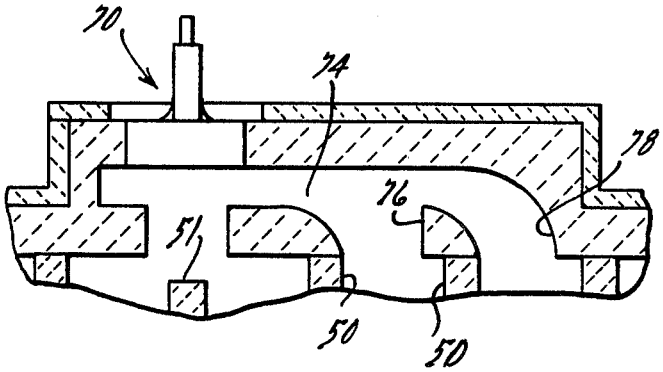
FIG. 8 is a horizontal sectional view taken on line 8—8 of FIG. 7.

Fan means of the kind described herein are particularly well suited for use in multi-row pusher type furnaces. As shown in FIG. 6, the piers 50 and 51 are designed in such a way as to form three rows or tracks 80, 82 and 84 extending through the furnace. When the invention is used in a multi-row carburizing furnace of the kind shown in FIG. 6, the floor 10 opposite the fan inlets may be provided with refractory brick 86 having upper surfaces 88 which slope downwardly transversely of the furnace from one side wall toward the wall in which the fan is mounted. The sloping upper surfaces 88 of the floor are designed so as to obtain a substantially uniform flow rate through the work in each of the rows 80, 82 and 84. The refractory brick 86, which may be considered to be a baffle means, may be given any other suitable configuration to provide substantially uniform flow through the work, and may be located wherever necessary on the floor of the furnace to achieve this result. The configuration and location of the baffle means will of course depend on the furnace width, the number of rows of work trays and other factors.

By the use of fans having both their inlet and outlet sides disposed below the level of the work, there is a controlled and substantially uniform flow throughout the longitudinal extent of a processing zone. This fan location in combination with an appropriate refractory design, as indicated in FIG. 6, also provides a controllable and uniform flow through the work throughout the width of the processing zone. It is to be noted that in each of the processing zones the controlled atmosphere flows downwardly through the work at one or more pier positions and upwardly through the work at one or more pier positions within that zone, thus insuring a more uniform distribution of the atmosphere over all surfaces of the work being processed.

The furnace is provided with the usual means for supplying the appropriate gas atmosphere to each of the several zones of the furnace and for drawing off the effluent. These conventional devices are not illustrated herein since they form no part of the present invention. However, it should be noted that the fan arrangement described herein minimizes the flow of the atmosphere from one zone into an adjacent zone. The atmosphere circulation within each zone tends to follow a generally circular pattern within that zone, thus reducing the intermixing of the atmospheres within adjacent zones. While the invention has been described in connection with a three-row pusher type carburizing furnace, it will be apparent that the fan construction described is equally well suited for use in furnaces adapted to process one or more rows of work trays.

It is also contemplated that the discharge zone 42 may be provided with a fan means of the type described if desired.

Figure 9:
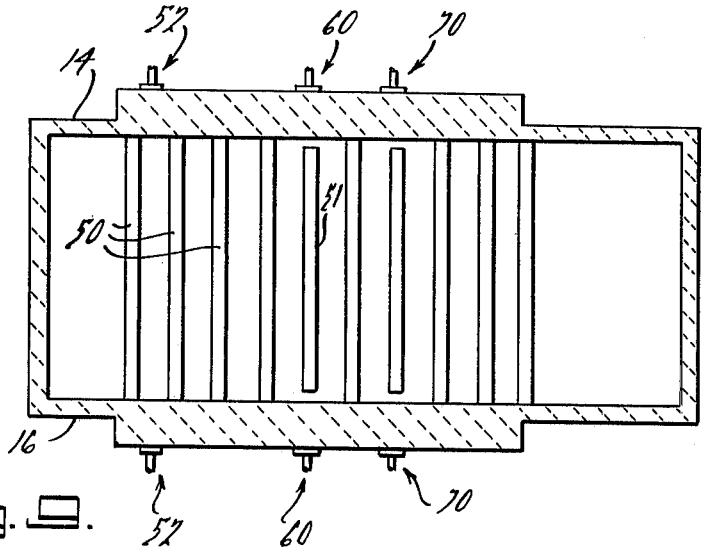
FIG. 9 is a horizontal sectional view similar to FIG. 3 showing a modified form of the invention.
Figure 10:
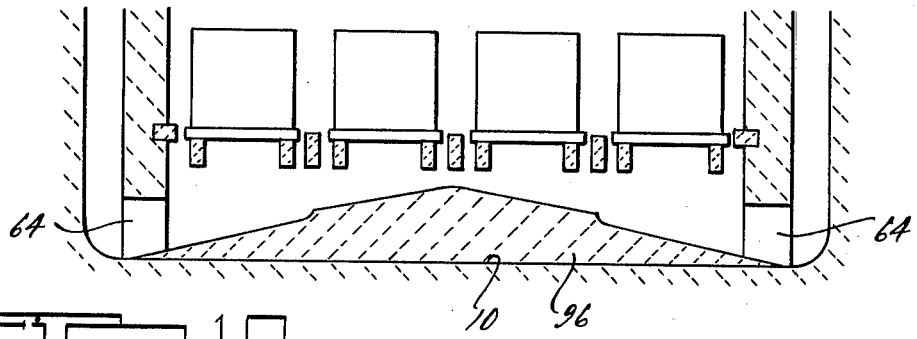
FIG. 10 is a sectional view taken on line 9—9 of FIG. 10.
Figure 11:
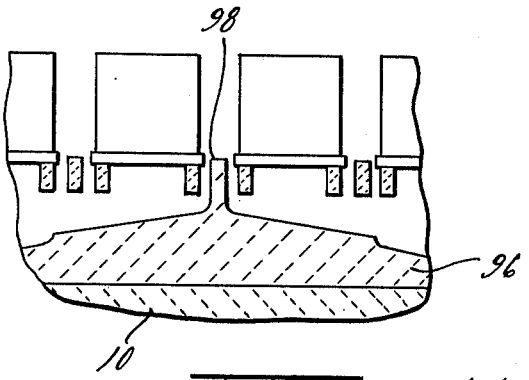
FIG. 11 is a sectional view similar to FIG. 10 showing a further modification of the invention.

FIGS. 9, 10 and 11 illustrate modified forms of the invention in which each of the processing zones is provided with a fan in both of the side walls of the furnace. As shown in FIG. 9, a fan 52 is mounted in each of the side walls 14 and 16 of the furnace in the heating zone 36. A fan 60 is mounted in each side wall in the carburizing zone 38 and a fan 70 is mounted in each side wall in the diffusing zone 40. In each of the zones 36, 38 and 40 the fans are mounted so that their inlets are directly opposite each other and the outlets thereof are similarly disposed. A furnace having fans disposed in both of the side walls may be appropriate for wider furnaces such as those employing four or more rows of work trays. As shown in FIG. 10, the furnace may have four rows of work trays and the furnace floor 10 opposite the fan outlets 64 may be provided with baffle means of the kind previously described. In this form of the invention the refractory brick 96 slopes downwardly from the longitudinal center line of the furnace toward the fan outlets 64. With this arrangement, each fan circulates the furnace atmosphere through the work trays in the two rows which are closest to the wall in which the fan is mounted.

FIG. 11 discloses a modified form of the invention shown in FIGS. 9 and 10 in which the refractory brick 96 has a dam portion 98 at the center thereof which extends upwardly into close proximity to the bottom of the adjacent work trays so as to more definitely insure that each fan will circulate the atmosphere through only one half of the width of the furnace.

While the fan arrangement in FIGS. 9 and 10 is illustrated as used in a four-row furnace, it is apparent that this construction may be used in furnaces having two or more rows of work trays. This construction will be useful in furnaces having only two rows of work trays where the work trays may be exceptionally wide as well as being useful in furnaces having more than two rows of work trays.

The invention is applicable to any one or more of the zones of a continuous type of furnace and to multi-chamber furnaces of the kind shown in U.S. Pat. No. 3,662,996. It will also be apparent that the invention may be used in carrying out other processes wherein the work is to be subjected to a controlled gas atmosphere or is required to be subjected to uniform surface treatment.

What I claim as my invention is:

1. Carburizing apparatus comprising a furnace having means defining heating, carburizing and diffusion zones, longitudinally spaced piers mounted on the floor of said furnace in each of said zones and extending transversely between the side walls of said furnace, track means on said piers and means for conveying a plurality of work trays along said track means successively through said zones, means for introducing into each of said zones a gas atmosphere appropriate to that zone, and fan means in each zone for circulating the atmosphere therein through the work in said zone, said fan means each comprising a fan mounted in a side wall of said furnace and having its inlet and its outlet in said side wall below the level of said track means with said inlet and outlet being longitudinally spaced apart and separated by at least one of the piers in said zone, whereby atmosphere is circulated downwardly through the work at one pier position and upwardly through the work at an adjacent pier position within said zone.

2. Apparatus according to claim 1, wherein said fans have their outlets positioned to discharge atmosphere transversely across said furnace floor beneath said work trays.

3. Carburizing apparatus according to claim 2 wherein said fans have their outlets disposed at the level of the top of said furnace floor, and said floor opposite said outlets slopes generally downwardly toward said fan outlets.

4. Carburizing apparatus comprising a furnace having means defining heating, carburizing and diffusion zones, longitudinally spaced piers mounted on the floor of said furnace in each of said zones and extending transversely between the side walls of said furnace, track means on said piers and means for conveying a plurality of work trays along said track means successively through said zones, means for introducing into each of said zones a gas atmosphere appropriate to that zone, and fan means in at least one of said zones for circulating the atmosphere therein through the work in said zone, said fan means comprising a fan mounted in one side wall of said furnace and having its inlet and its outlet in said one side wall below the level of said track means with said inlet and outlet being longitudinally spaced apart and separated by at least one of the piers in said zone, whereby atmosphere is circulated downwardly through the work at one pier position and upwardly through the work at an adjacent pier position within said zone.

5. Apparatus according to claim 4 wherein said fan has its outlet positioned to direct atmosphere discharged therefrom toward the opposite furnace side wall.

6. Carburizing apparatus according to claim 5 wherein said fan has its outlet disposed adjacent said furnace floor and said floor opposite said fan outlet slopes downwardly toward said outlet.

7. Apparatus according to claim 5 wherein said furnace is provided with means for conveying at least two longitudinally extending rows of work trays through said processing zone, said furnace floor opposite said fan outlet having provisions thereon for distributing the atmosphere discharged from said fan outlet substantially uniformly across said rows beneath said work trays.

8. Work processing apparatus comprising a furnace having means defining a work processing zone, longitudinally spaced piers mounted on the floor of said furnace in said zone and extending transversely between the side walls of said furnace, means for conveying a plurality of work trays through said zone above said piers, and fan means for circulating the atmosphere therein through the work in said zone, said fan means comprising a fan mounted in one side wall of said furnace and having its inlet and its outlet in said one side wall below the level of said work trays with said inlet and outlet being longitudinally spaced apart and separated by at least one of the piers in said zone, whereby atmosphere is circulated downwardly through the work at one pier position and upwardly through the work at an adjacent pier position.

9. Apparatus according to claim 8 wherein said fan has its outlet positioned to discharge atmosphere transversely across said furnace floor.

10. Apparatus according to claim 9 wherein said furnace floor is provided with baffle means for distributing the atmosphere discharged by said fan substantially uniformly across the width of said furnace.

11. Carburizing apparatus comprising a furnace having means defining heating, carburizing and diffusion zones, longitudinally spaced piers mounted on the floor of said furnace in each of said zones and extending transversely between the side walls of said furnace, track means on said piers and means for conveying a plurality of work trays along said track means successively through said zones, means for introducing into each of said zones a gas atmosphere appropriate to that zone, and fan means in each zone for circulating the atmosphere therein through the work in said zone, said fan means each comprising a fan mounted in each side wall of said furnace and having their inlets and outlets in said side walls below the level of said track means with the inlet and outlet of each fan being longitudinally spaced apart and separated by at least one of the piers in their respective zone, whereby atmosphere is circulated downwardly through the work at one pier position and upwardly through the work at an adjacent pier position within each zone.

12. Carburizing apparatus according to claim 11 wherein said fans have their outlets disposed at the level of the top of said furnace floor, and said floor opposite said outlets slopes generally downwardly toward said fan outlets.

13. Work processing apparatus comprising a furnace having means defining a work processing zone, longitudinally spaced piers mounted on the bottom wall of said furnace in said zone and extending transversely between the side walls of said furnace, means for conveying a plurality of rows of work trays through said zone above said piers, and fan means for circulating the atmosphere therein through the work in said zone, said fan means comprising a fan mounted in each side wall of said furnace and having its inlet and its outlet below the level of said work trays with the inlet and outlet of each fan being longitudinally spaced apart and separated by at least one of the piers in said zone, whereby atmosphere is circulated downwardly through the work at one pier position and upwardly through the work at an adjacent pier position.

14. Apparatus according to claim 13 wherein the outlets of said fans are disposed directly opposite each other to discharge atmosphere across said furnace floor toward the center thereof.

15. Apparatus according to claim 14 wherein said furnace floor is provided with baffle means for distributing the atmosphere discharged by said fans substantially uniformly across the width of said furnace.

16. Apparatus according to claim 13 including means to restrict the discharge from each fan to less than the full width of said furnace.

* * * * *